US012064010B2

(12) United States Patent
Hausmann et al.

(10) Patent No.: US 12,064,010 B2
(45) Date of Patent: Aug. 20, 2024

(54) ARTICLE OF FOOTWEAR HAVING A CHAIN-LINKED TENSILE SUPPORT STRUCTURE

(71) Applicant: NIKE, Inc., Beaverton, OR (US)

(72) Inventors: Stephan Hausmann, Happy Valley, OR (US); Laura C. Parrett, Portland, OR (US); Robert C. Williams, Jr., Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 319 days.

(21) Appl. No.: 15/211,033

(22) Filed: Jul. 15, 2016

(65) Prior Publication Data

US 2017/0020231 A1 Jan. 26, 2017

Related U.S. Application Data

(60) Provisional application No. 62/194,670, filed on Jul. 20, 2015.

(51) Int. Cl.

| | |
|---|---|
| ***A43B 23/02*** | (2006.01) |
| ***A43B 1/04*** | (2022.01) |
| ***A43B 3/12*** | (2006.01) |
| ***A43B 5/00*** | (2022.01) |
| ***A43B 5/02*** | (2006.01) |
| ***A43B 5/06*** | (2022.01) |
| ***A43B 5/14*** | (2006.01) |

(Continued)

(52) U.S. Cl.

CPC ..... *A43B 23/028* (2013.01); *A43B 1/04* (2013.01); *A43B 3/12* (2013.01); *A43B 5/002* (2013.01); *A43B 5/02* (2013.01); *A43B 5/06* (2013.01); *A43B 5/14* (2013.01); *A43B 13/12* (2013.01); *A43B 13/181* (2013.01); *A43B 13/187* (2013.01); *A43B 23/021* (2013.01); *A43B 23/0215* (2013.01); *A43B 23/0235* (2013.01); *A43B 23/026* (2013.01); *A43B 23/0265* (2013.01); *A43C 1/04* (2013.01); *A43C 5/00* (2013.01)

(58) Field of Classification Search

CPC ..... A43B 23/028; A43B 1/04; A43B 3/12; A43B 23/0265; A43B 5/002; A43B 5/02; A43B 5/14; A43B 13/181; D04C 1/02; A43C 1/04

USPC ..... 36/50.1; 428/36.1

See application file for complete search history.

(56) References Cited

U.S. PATENT DOCUMENTS

| | | | |
|---|---|---|---|
| 4,858,339 | A | 8/1989 | Hayafuchi et al. |
| 7,293,371 | B2 | 11/2007 | Aveni |

(Continued)

FOREIGN PATENT DOCUMENTS

| | | | |
|---|---|---|---|
| CN | 102595951 | A | 7/2012 |
| CN | 103844428 | A | 6/2014 |

(Continued)

*Primary Examiner* — Alissa J Tompkins
*Assistant Examiner* — Catherine M Ferreira
(74) *Attorney, Agent, or Firm* — Klarquist Sparkman, LLP

(57) ABSTRACT

Articles of footwear having an upper that includes a tensile support structure are described. The tensile support structure is formed by a plurality of strands that are arranged in a chain-linked configuration. The chain-linked arrangement of the strands assists with distributing tensile forces over portions of the upper of the article of footwear and helps to conforms the upper to a foot of a wearer upon the application of tension.

12 Claims, 15 Drawing Sheets

(51) Int. Cl.

| | |
|---|---|
| ***A43B 13/12*** | (2006.01) |
| ***A43B 13/18*** | (2006.01) |
| ***A43C 1/04*** | (2006.01) |
| ***A43C 5/00*** | (2006.01) |

(56) References Cited

U.S. PATENT DOCUMENTS

| | | | | |
|---|---|---|---|---|
| 7,841,106 | B2 | 11/2010 | Farys | |
| 8,225,530 | B2 | 7/2012 | Sokolowski et al. | |
| 8,819,963 | B2 * | 9/2014 | Dojan | A43B 23/0265 36/45 |
| 8,850,723 | B2 | 10/2014 | Greene et al. | |
| 2001/0008053 | A1 | 7/2001 | Belli | |
| 2006/0172515 | A1 * | 8/2006 | Olivero | B81C 1/00142 438/515 |
| 2006/0283042 | A1 * | 12/2006 | Greene | A43B 9/00 36/3 A |
| 2007/0271823 | A1 * | 11/2007 | Meschter | A43B 9/02 36/45 |
| 2009/0071041 | A1 * | 3/2009 | Hooper | A43B 7/06 36/3 A |
| 2012/0017468 | A1 * | 1/2012 | Dojan | A43B 5/06 36/47 |
| 2012/0055044 | A1 * | 3/2012 | Dojan | A43D 111/00 36/83 |
| 2014/0130372 | A1 * | 5/2014 | Aveni | A43B 3/128 36/83 |
| 2014/0173932 | A1 | 6/2014 | Bell | |
| 2014/0173934 | A1 * | 6/2014 | Bell | A43B 23/0265 36/84 |
| 2014/0223779 | A1 * | 8/2014 | Elder | A43C 1/04 36/103 |
| 2014/0310983 | A1 | 10/2014 | Tamm et al. | |
| 2014/0377488 | A1 * | 12/2014 | Jamison | D04C 1/10 428/221 |
| 2015/0007451 | A1 | 1/2015 | Bruce | |
| 2015/0013193 | A1 | 1/2015 | Krueger | |
| 2015/0052778 | A1 | 2/2015 | Kirk et al. | |
| 2015/0113836 | A1 | 4/2015 | Polegato Moretti | |
| 2015/0201707 | A1 * | 7/2015 | Bruce | A43B 23/042 36/47 |
| 2016/0309843 | A1 * | 10/2016 | Song | A43B 7/06 |
| 2019/0223541 | A1 * | 7/2019 | Aceves Tinajero | A43B 23/04 |

FOREIGN PATENT DOCUMENTS

| | | | |
|---|---|---|---|
| CN | 107105813 | A | 8/2017 |
| FR | 2902982 | A1 | 7/2006 |
| WO | WO 2014/209596 | A1 | 12/2014 |

* cited by examiner

ARTICLE OF FOOTWEAR HAVING A CHAIN-LINKED TENSILE SUPPORT STRUCTURE

CROSS REFERENCE TO RELATED APPLICATION

This non-provisional patent application claims the benefit of priority under 35 U.S.C. § 119(e) to U.S. Provisional Patent Application Ser. No. 62/194,670, which was filed in the U.S. Patent and Trademark Office on Jul. 20, 2015 and entitled "Article of Footwear Having A Chain-Linked Tensile Support Structure", the disclosure of which application is incorporated by reference in its entirety.

BACKGROUND

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
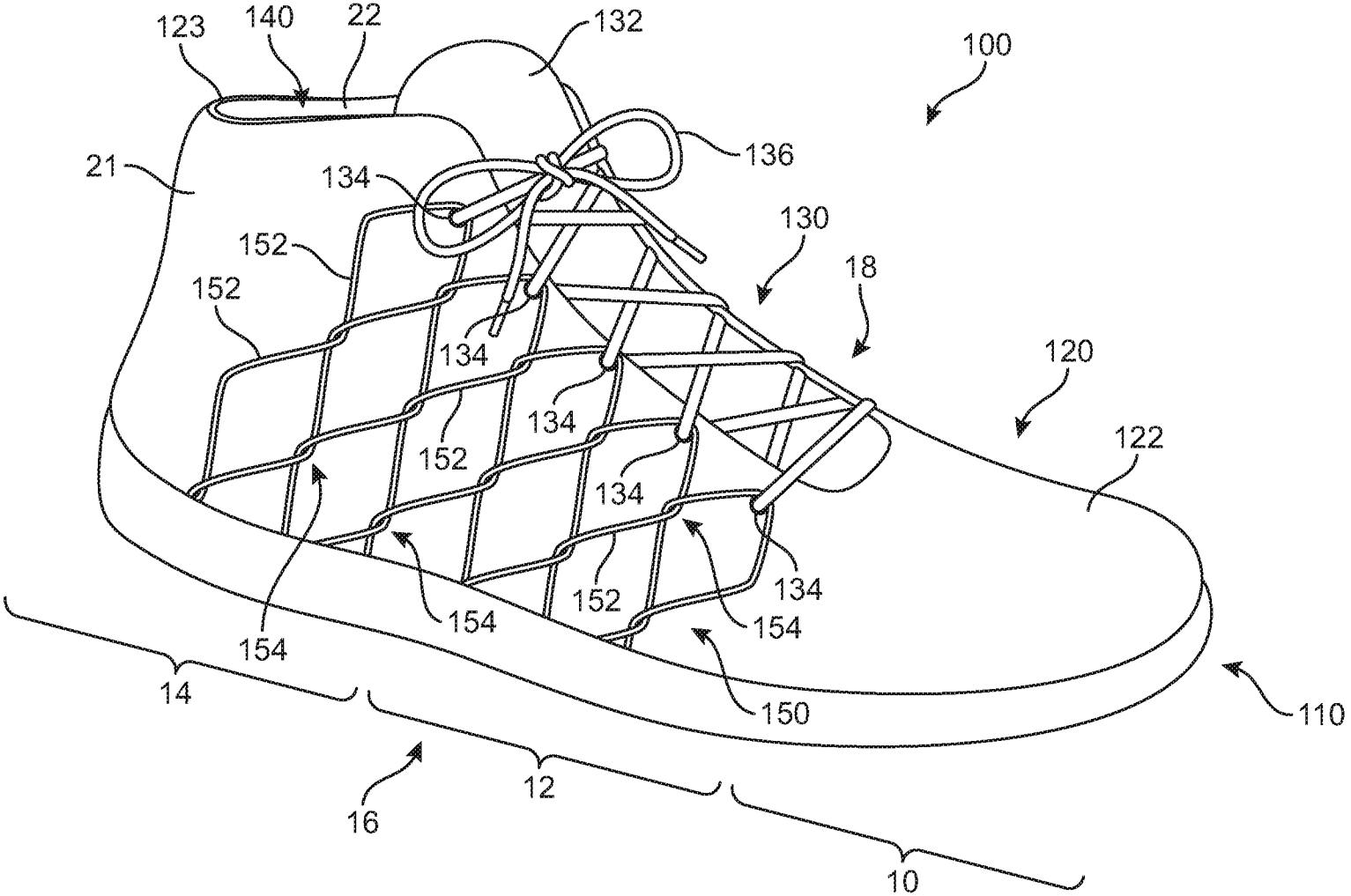
FIG. 1 is an isometric view of an exemplary embodiment of an article of footwear including a tensile support structure.

The following discussion and accompanying figures disclose articles of footwear having an upper that includes a tensile support structure. The tensile support structure is formed by a plurality of strands that are arranged in a chain-linked configuration. The articles of footwear are disclosed as having a general configuration suitable for walking or running. Concepts related to the article of footwear, including the upper, may also be applied to a variety of other athletic footwear types, including baseball shoes, basketball shoes, cross-training shoes, cycling shoes, football shoes, tennis shoes, soccer shoes, and hiking boots, for example. The concepts may also be applied to footwear types that are generally considered to be non-athletic, including dress shoes, loafers, sandals, and work boots. The concepts disclosed herein apply, therefore, to a wide variety of footwear types.

In one aspect of the embodiments, an article of footwear having an upper and a sole structure secured to the upper is provided. The upper can include a base layer having an interior surface and an opposite exterior surface, the base layer forming at least a portion of the upper of the article of footwear. The upper can further include a tensile support structure disposed proximate to the exterior surface of the base layer, the tensile support structure comprising a plurality of strands that extend between a lace region of the upper and a lower region of the upper. The plurality of strands can be joined together in a chain-link arrangement through the tensile support structure.

In another aspect of the embodiments, an article of footwear having an upper and a sole structure secured to the upper is provided. The upper can incorporate a knitted component. The knitted component can form at least a portion of the upper of the article of footwear. The upper can also include a tensile support structure that comprises a plurality of strands that extend through the knitted component between a lace region of the upper and a lower region of the upper. The plurality of strands can be joined in a chain-link arrangement through the tensile support structure.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

FIGS. 1 through 7 illustrate an exemplary embodiment of an article of footwear 100, also referred to simply as article 100. In some embodiments, article of footwear 100 may include a sole structure 110 and an upper 120. Although article 100 is illustrated as having a general configuration suitable for training, concepts related to article 100 may also be applied to a variety of other athletic footwear types, including running shoes, soccer shoes, baseball shoes, basketball shoes, cycling shoes, football shoes, tennis shoes, walking shoes, and hiking boots, for example. The concepts may also be applied to footwear types that are generally considered to be non-athletic, including dress shoes, loafers, sandals, and work boots. Accordingly, the concepts disclosed with respect to article 100 may be applied to a wide variety of footwear types.

Figure 2:
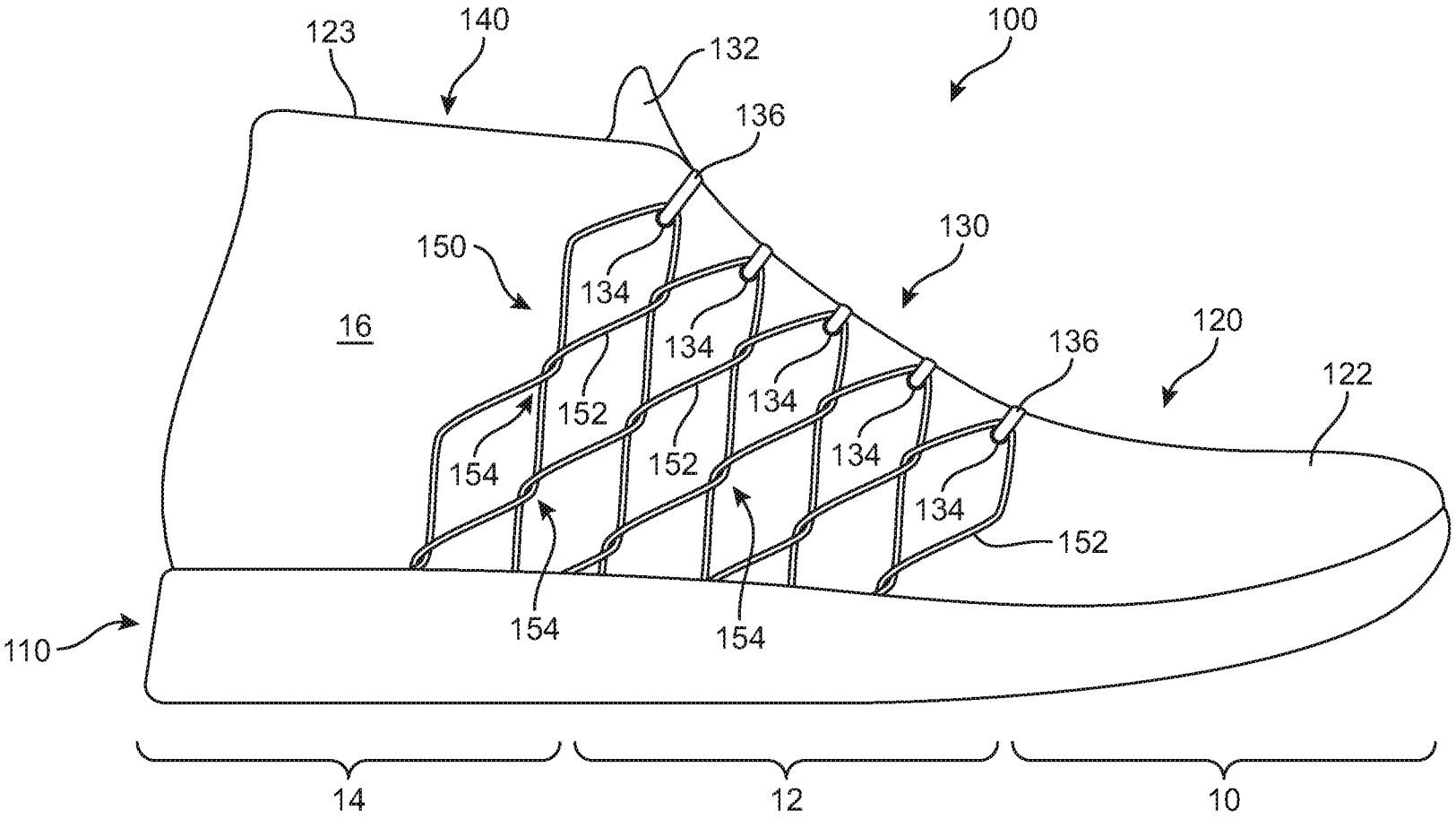
FIG. 2 is a lateral side view of the exemplary embodiment of an article of footwear including a tensile support structure.
Figure 3:
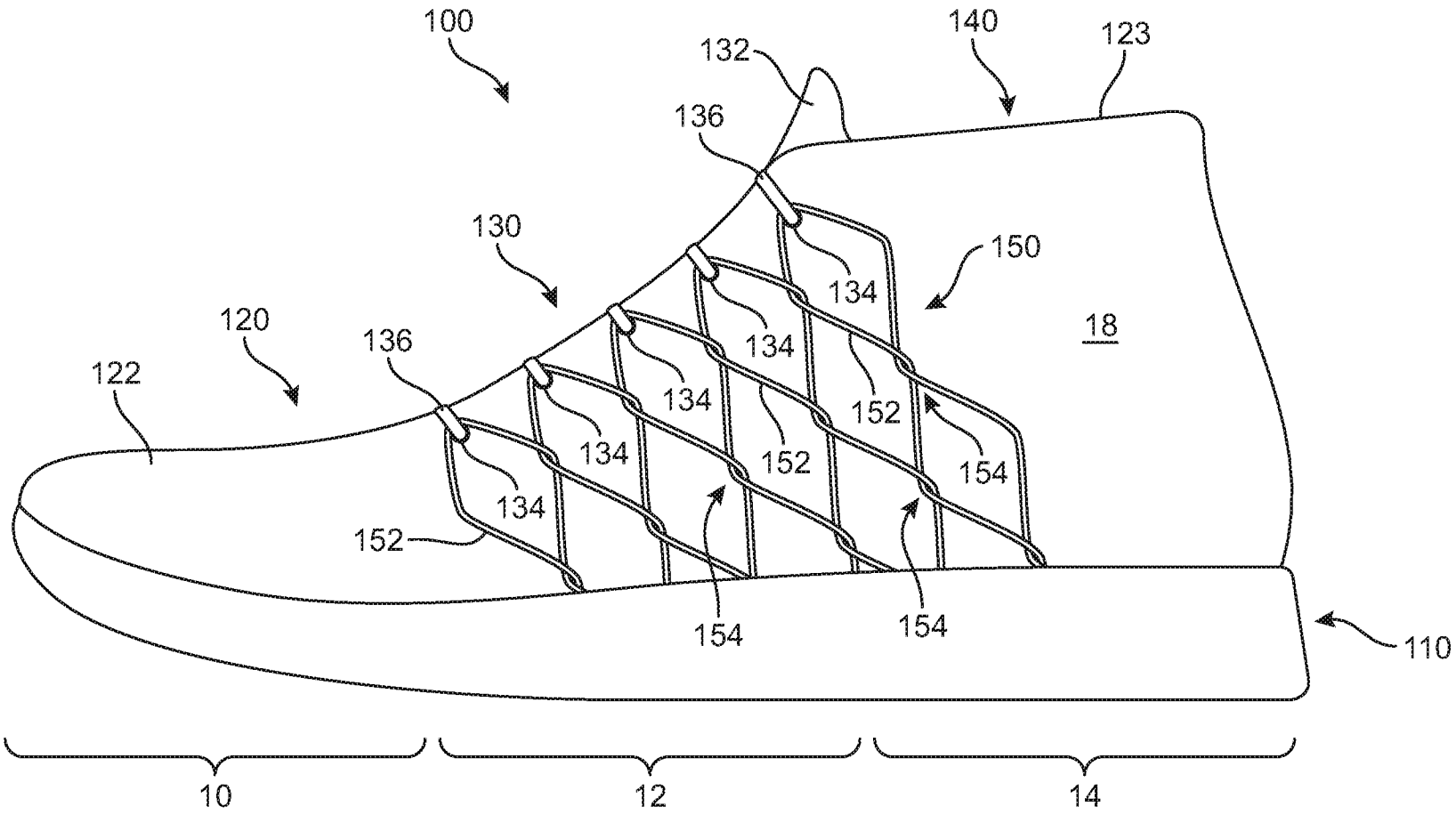
FIG. 3 is a medial side view of the exemplary embodiment of an article of footwear including a tensile support structure.

For reference purposes, article 100 may be divided into three general regions: a forefoot region 10, a midfoot region 12, and a heel region 14, as shown in FIGS. 1, 2, and 3. Forefoot region 10 generally includes portions of article 100 corresponding with the toes and the joints connecting the metatarsals with the phalanges. Midfoot region 12 generally includes portions of article 100 corresponding with an arch area of the foot. Heel region 14 generally corresponds with rear portions of the foot, including the calcaneus bone. Article 100 also includes a lateral side 16 and a medial side 18, which extend through each of forefoot region 10, midfoot region 12, and heel region 14 and correspond with opposite sides of article 100. More particularly, lateral side 16 corresponds with an outside area of the foot (i.e., the surface that faces away from the other foot), and medial side 18 corresponds with an inside area of the foot (i.e., the surface that faces toward the other foot). Forefoot region 10, midfoot region 12, and heel region 14 and lateral side 16, medial side 18 are not intended to demarcate precise areas of article 100. Rather, forefoot region 10, midfoot region 12, and heel region 14 and lateral side 16, medial side 18 are intended to represent general areas of article 100 to aid in the following discussion. In addition to article 100, forefoot region 10, midfoot region 12, and heel region 14 and lateral side 16, medial side 18 may also be applied to sole structure 110, upper 120, and individual elements thereof.

In an exemplary embodiment, sole structure 110 is secured to upper 120 and extends between the foot and the ground when article 100 is worn. In some embodiments, sole structure 110 may include one or more optional components, including a midsole, an outsole, and/or a sockliner or insole.

Upper 120 defines a void within article 100 for receiving and securing a foot relative to sole structure 110. The void is shaped to accommodate the foot and extends along a lateral side of the foot, along a medial side of the foot, over the foot, around the heel, and under the foot. In an exemplary embodiment, upper 120 is formed from a base layer 122. The various portions of upper 120, including base layer 122, may be formed from one or more of a plurality of material elements (e.g., textiles, polymer sheets, foam layers, leather, synthetic leather) that can form the majority of upper 120 or portions can be stitched or bonded together to form upper 120 defining the void within article 100.

Base layer 122 of upper 120 includes an exterior surface 21 and an opposite interior surface 22. Whereas exterior surface 21 faces outward and away from article 100, interior surface 22 faces inward and defines a majority or a relatively large portion of the void within article 100 for receiving the foot. Moreover, interior surface 22 may lay against the foot or a sock covering the foot. Upper 120 may also include a collar 123 that is located in at least heel region 14 and forms a throat opening 140. Access to the interior void of upper 120 is provided by throat opening 140. More particularly, the foot may be inserted into upper 120 through throat opening 140 formed by collar 123, and the foot may be withdrawn from upper 120 through throat opening 140 formed by collar 123. In some embodiments, a lacing region 130 extends forward from collar 123 and throat opening 140 in heel region 14 over an area corresponding to an instep of the foot in midfoot region 12 to an area adjacent to forefoot region 10.

In some embodiments, a lace 136 extends through various lace-receiving elements to permit the wearer to modify dimensions of upper 120 to accommodate the proportions of the foot. In the exemplary embodiments, lace-receiving elements are configured as a plurality of lace apertures 134. More particularly, lace 136 permits the wearer to tighten upper 120 around the foot, and lace 136 permits the wearer to loosen upper 120 to facilitate entry and removal of the foot from the interior void (i.e., through ankle opening 140). As an alternative to plurality of lace apertures 134, upper 120 may include other lace-receiving elements, such as loops, eyelets, and D-rings. In addition, upper 120 includes a tongue 132 that extends between the interior void and lace 136 to enhance the comfort of article 100.

Figure 4:
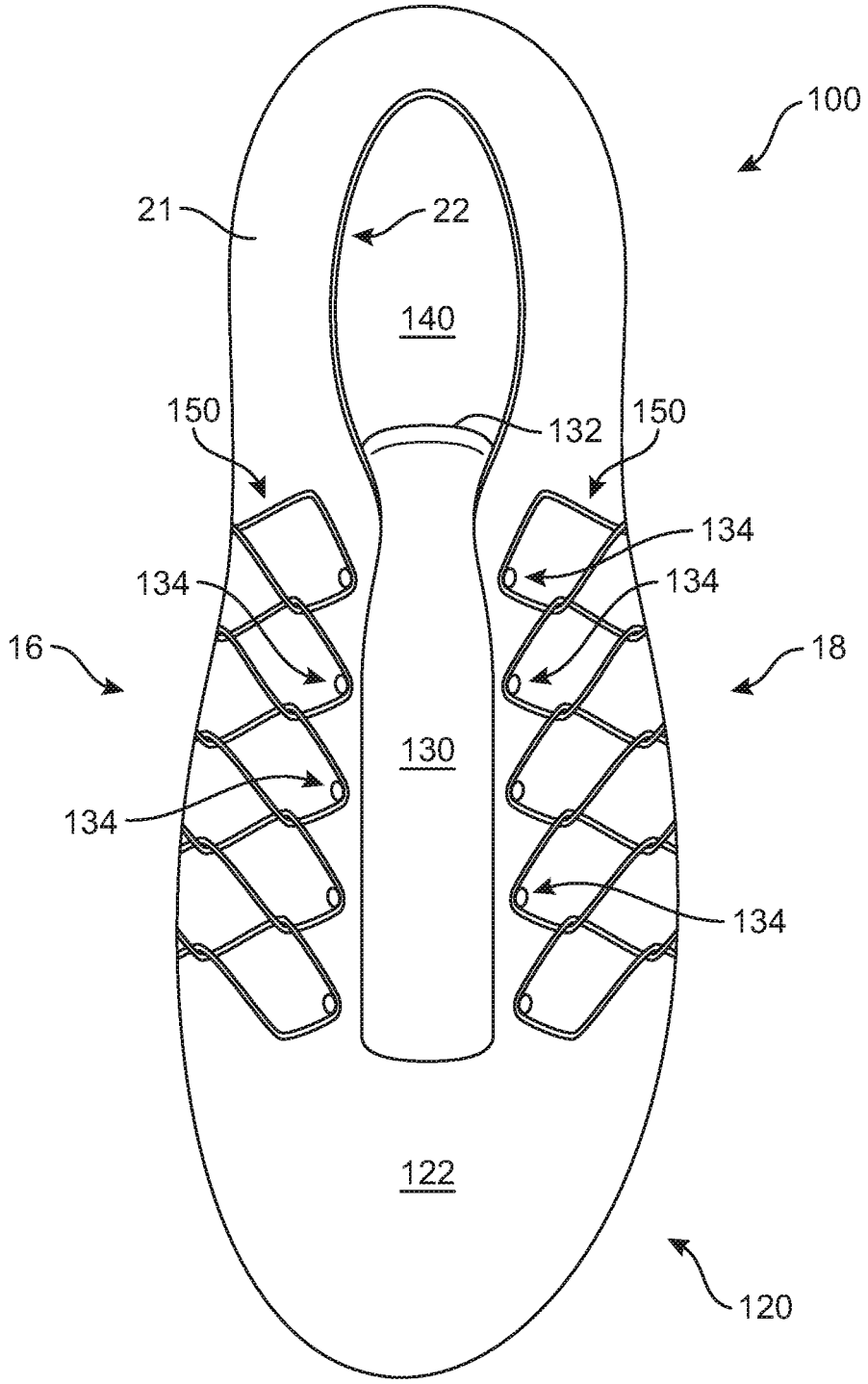
FIG. 4 is a top down view of the exemplary embodiment of an article of footwear including a tensile support structure.

Article 100 may be provided with a tensile support structure 150 that is disposed across upper 120. Tensile support structure 150 can be configured to distribute tensile forces over portions of upper 120 and can further be configured to conform upper 120 to a foot of a wearer upon application of tension. In an exemplary embodiment, article 100 includes tensile support structure 150 located on each of lateral side 16 and medial side 18. For example, as shown in FIG. 4, tensile support structure 150 is present on lateral side 16 and medial side 18, and extends towards lacing region 130 on opposite sides of tongue 132. In one embodiment, each portion of tensile support structure 150 on respective lateral side 16 and medial side 18 can be configured independently of one another. In other embodiments, however, the portions of tensile support structure 150 on each of lateral side 16 and medial side 18 may be connected to each other.

Tensile support structure 150 provides an arrangement that permits tensile forces to be distributed across portions of upper 120. In an exemplary embodiment, tensile support structure 150 includes a plurality of strands 152 that are joined together in a chain-link arrangement. That is, each of strands 152 are interconnected or intertwined with each other across tensile support structure 150.

During activities that involve walking, running, or other ambulatory movements (e.g., cutting, braking), a foot within the interior void of article 100 may tend to stretch upper 120. That is, many of the material elements forming upper 120 may stretch when placed in tension by movements of the foot. Although plurality of strands 152 may also stretch to some degree, plurality of strands 152 generally stretch to a lesser degree than the other material elements forming upper 120 (e.g., base layer 122). Plurality of strands 152 may be configured in a chain-linked arrangement, therefore, to form tensile support structure 150 extending across upper 120 that distributes tensile forces over portions of upper 120 and conforms upper 120 to a foot of a wearer upon application of tension to ensure that the foot remains properly positioned relative to sole structure 110 and upper 120.

Plurality of strands 152 may be formed by tensile elements made of generally elongate materials exhibiting a length that is substantially greater than a width and a thickness. Accordingly, suitable materials for plurality of strands 152 include various filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra-high molecular weight polyethylene, liquid crystal polymer, copper, aluminum, and steel. Additional examples of suitable tensile elements for plurality of strands 152 can include strands disclosed in commonly-owned U.S. Pat. No. 8,631,589 to Dojan, the disclosure of which is hereby incorporated by reference in its entirety. Other similar materials may be used as tensile elements forming plurality of strands 152.

In some cases, plurality of strands 152 may be formed by individual and separate tensile elements for each of the strands of tensile support structure 150. In other cases, the plurality of strands 152 may be formed by a plurality of sections of one or more tensile elements. In either case, plurality of strands 152 can include a plurality of sections of a tensile element, or a plurality of tensile elements, or both.

In some embodiments, tensile support structure 150 is located adjacent to exterior surface 21 of base layer 122 of upper 120 and extends substantially parallel over exterior surface 21. In addition, tensile support structure 150 is attached to upper 120 and/or sole structure 110 at a lower region of upper 120 where sole structure 110 and upper 120 are attached. For example, plurality of strands 152 may be secured to lower surface 123 of upper 120 and/or to top surface 111. In some cases, plurality of strands 152 can be located between lower surface 123 and top surface 111 to secure tensile support structure 150 at the lower region of upper 120. In other cases, plurality of strands 152 can be attached directly to different portions of upper 120 and/or sole structure 110.

In the present embodiments, plurality of strands 152 are fixed to upper 120 at the lower region, but can remain unsecured to upper 120 in an area between the lower region and lacing region 130. Tensile support structure 150 can remain in loose contact with exterior surface 21 of upper 120 in this area. While plurality of strands 152 remain unsecured to upper 120 in the area between the lower region and lacing region 130, plurality of strands 152 are connected to one another at a plurality of intertwined links 154 across tensile support structure 150. At lacing region 130, loops formed by plurality of strands 152 of tensile support structure 150 can interact with lace 136 and plurality of lace apertures 134 so as to be connected to upper 120 at lacing region 130. With this arrangement, tensile support structure 150 can distribute tensile forces across various portions of upper 120.

As described above, the chain-linked arrangement of tensile support structure 150 can be formed by plurality of strands 152 being connected to adjacent portions at a plurality of intertwined links 154. Each of the intertwined links 154 is a connection between adjacent portions of plurality of strands 152 that partially wrap over and under each other to intertwine the adjacent portions of strands 152 together and form a link. Plurality of strands 152 are connected at plurality of intertwined links 154 across tensile support structure 150 to form a chain-linked arrangement of plurality of strands 152. Plurality of strands 152 can be repeatedly connected at intertwined links 154 at approximately regularly-spaced intervals across tensile support structure 150 so as to form the chain-linked arrangement having a plurality of diamond-shaped portions, as shown in the Figures.

Figure 5:
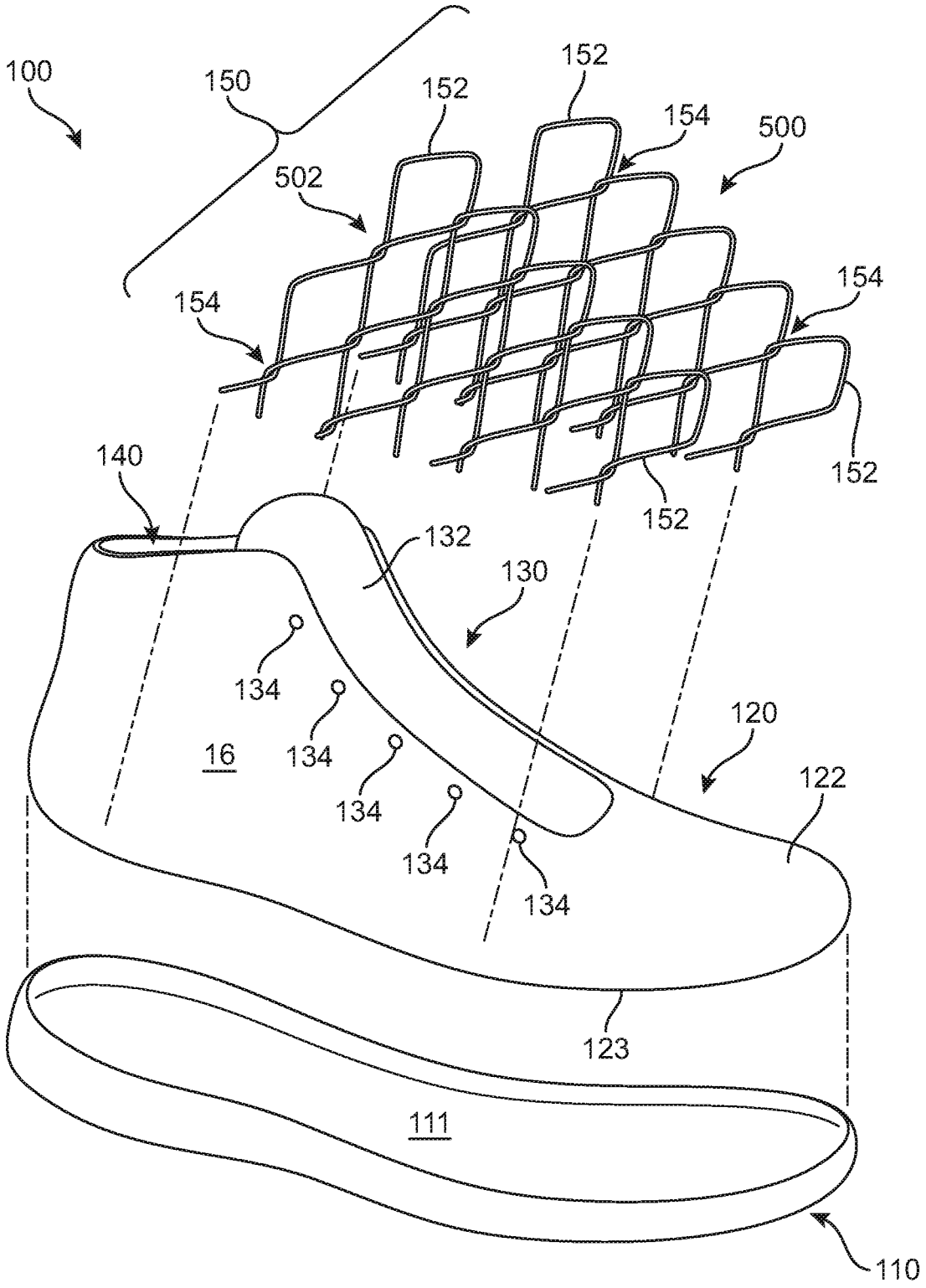
FIG. 5 is an exploded perspective view of the exemplary embodiment of an article of footwear including a tensile support structure.

As shown in FIG. 5, sole structure 110 includes a top surface 111 that is secured to a lower surface 123 of upper 120 configured for securing sole structure 110 to upper 120. Although this configuration for sole structure 110 provides an example of a sole structure that may be used in connection with upper 120, a variety of other conventional or nonconventional configurations for sole structure 110 may also be used. Accordingly, in other embodiments, the features of sole structure 110 or any sole structure used with upper 120 may vary.

For example, in other embodiments, sole structure 110 may include a midsole and/or a sockliner. A midsole may be secured to a lower surface of an upper and in some cases may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In other cases, a midsole may incorporate plates, moderators, fluid-filled chambers, lasting elements, or motion control members that further attenuate forces, enhance stability, or influence the motions of the foot. In still other cases, the midsole may be primarily formed from a fluid-filled chamber that is located within an upper and is positioned to extend under a lower surface of the foot to enhance the comfort of an article.

In some embodiments, tensile support structure 150 may include plurality of strands 152 arranged together to form separate tensile support structures for each side of the article of footwear 100. As shown in the embodiment of FIG. 5, tensile support structure 150 includes a medial side tensile support structure 500 and a lateral side tensile support structure 502 that are disposed on each side of article 100. In other embodiments, tensile support structure 150 can include plurality of strands 152 that are connected and/or continuous between opposite lateral side 16 and medial side 18 of article 100 so as to form tensile support structure 150 that has connected and/or continuous lateral and medial portions.

Figure 6:
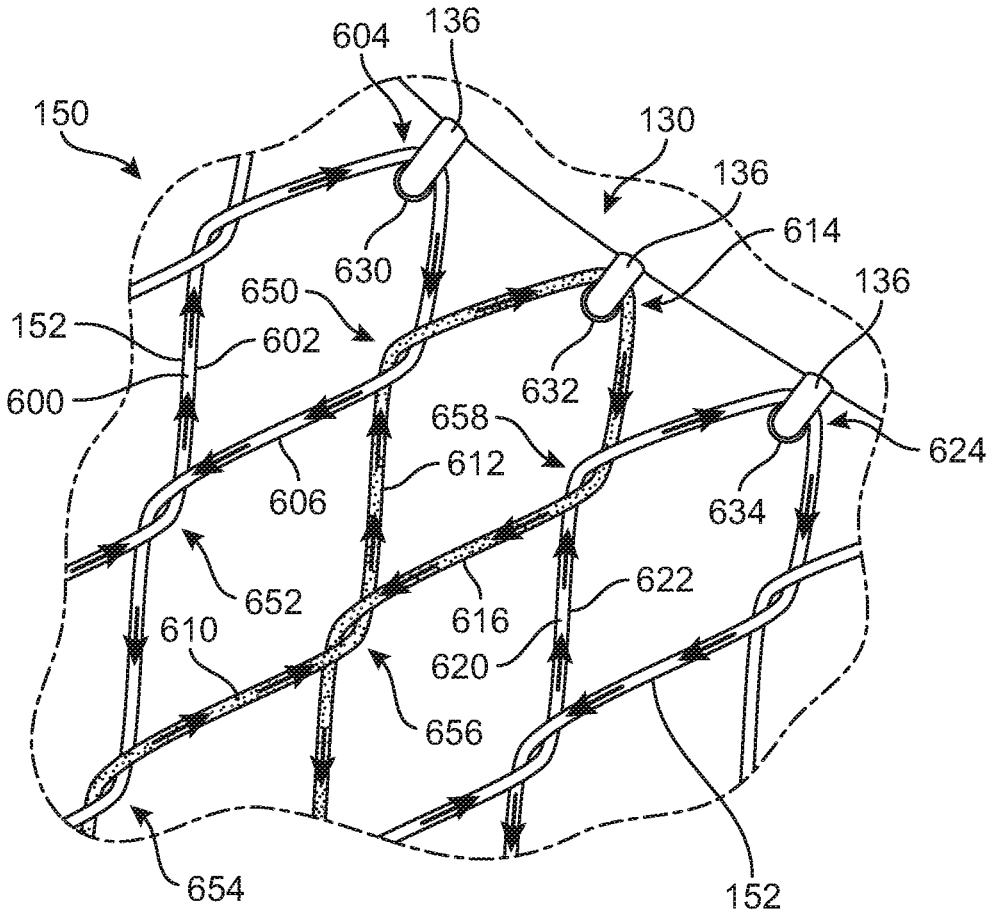
FIG. 6 is an enlarged view of a portion of the lateral side of the exemplary embodiment of an article of footwear.

Referring now to FIG. 6, an enlarged view of a portion of tensile support structure 150 is shown. As noted above, tensile support structure 150 is formed by one or more strands or strand sections of plurality of strands 152 that are connected at adjacent portions to form intertwined links 154. For example, in this embodiment, plurality of strands includes a first strand 600, a second strand 610, and a third strand 620. First strand 600 is located adjacent to second strand 610, and second strand 610 is located adjacent to third strand 620. In this embodiment, first strand 600 may be located more rearward along upper 120 towards heel region 14 and third strand may be located more forward along upper towards forefoot region 10.

In this embodiment, each of first strand 600, second strand 610, and third strand 620 include two portions extending between lacing region 130 and the lower region of upper 120 near sole structure 110. Together the two portions of each strand form a loop near lacing region 130 that extends over lace apertures 134 for receiving lace 136. For description purposes, the two portions may be described as an ascending portion and a descending portion, however, it should be understood that these terms do not necessarily describe or limit the method of assembly of the present embodiments.

For example, first strand 600 includes a first ascending portion 602 that extends upwards from the lower region near sole structure 110 in a direction towards lacing region 130. At lacing region 130, first strand 600 forms a first loop 604 that extends around first lace aperture 630 and a first descending portion 606 of first strand 600 extends back down from lacing region 130 in a direction towards the lower region of upper 120 near sole structure 110. In a similar manner, second strand 610 includes a second ascending portion 612 that extends upwards towards lacing region 130 and forms a second loop 614 around a second lace aperture 632 before a second descending portion 616 extends back towards the lower region of upper 120 near sole structure 110. Third strand 620 has a similar arrangement with a third ascending portion 622 that extends upwards towards lacing region 130 and forms a third loop 624 around a third lace aperture 634 before a third descending portion 626 extends back towards the lower region of upper 120 near sole structure 110.

In some embodiments, plurality of intertwined links 154 between adjacent portions of strands 152 can be described as being either self-linked or adjacent-linked. That is, intertwined links 154 may join portions of the same strand or portions of different strands of plurality of strands 152. As shown in FIG. 6, a first link 650 connects first descending portion 606 of first strand 600 and second ascending portion 612 of second strand 610. First link 650 may be described as being adjacent-linked because it connects adjacent ascending and descending portions of different strands, for example, first strand 600 and second strand 610. In comparison, a second link 652 connects first descending portion 606 of first strand 600 and first ascending portion 602 of first strand 600. Second link 652, therefore, may be described as being self-linked because it connects adjacent ascending and descending portions of the same strand, for example, first strand 600.

An arrangement of a combination of self-linked and adjacent-linked intertwined links 154 can continue across tensile support structure 150. Referring again to FIG. 6, a third link 654 connects first descending portion 606 of first strand 600 and second ascending portion 612 of second strand 610 a second time near the lower region of upper 120 near sole structure 110. Similarly, a fourth link 656 connects second ascending portion 612 and second descending portion 616 of second strand 610, and a fifth link 658 connects second descending portion 616 of second strand 610 with third ascending portion 622 of third strand 620. In this case, third link 654 and fifth link 658 are adjacent-linked, while fourth link 656 is self-linked. With this configuration, the chain-linked arrangement connecting plurality of strands 152 of tensile support structure 150 may be provided.

Figure 7:
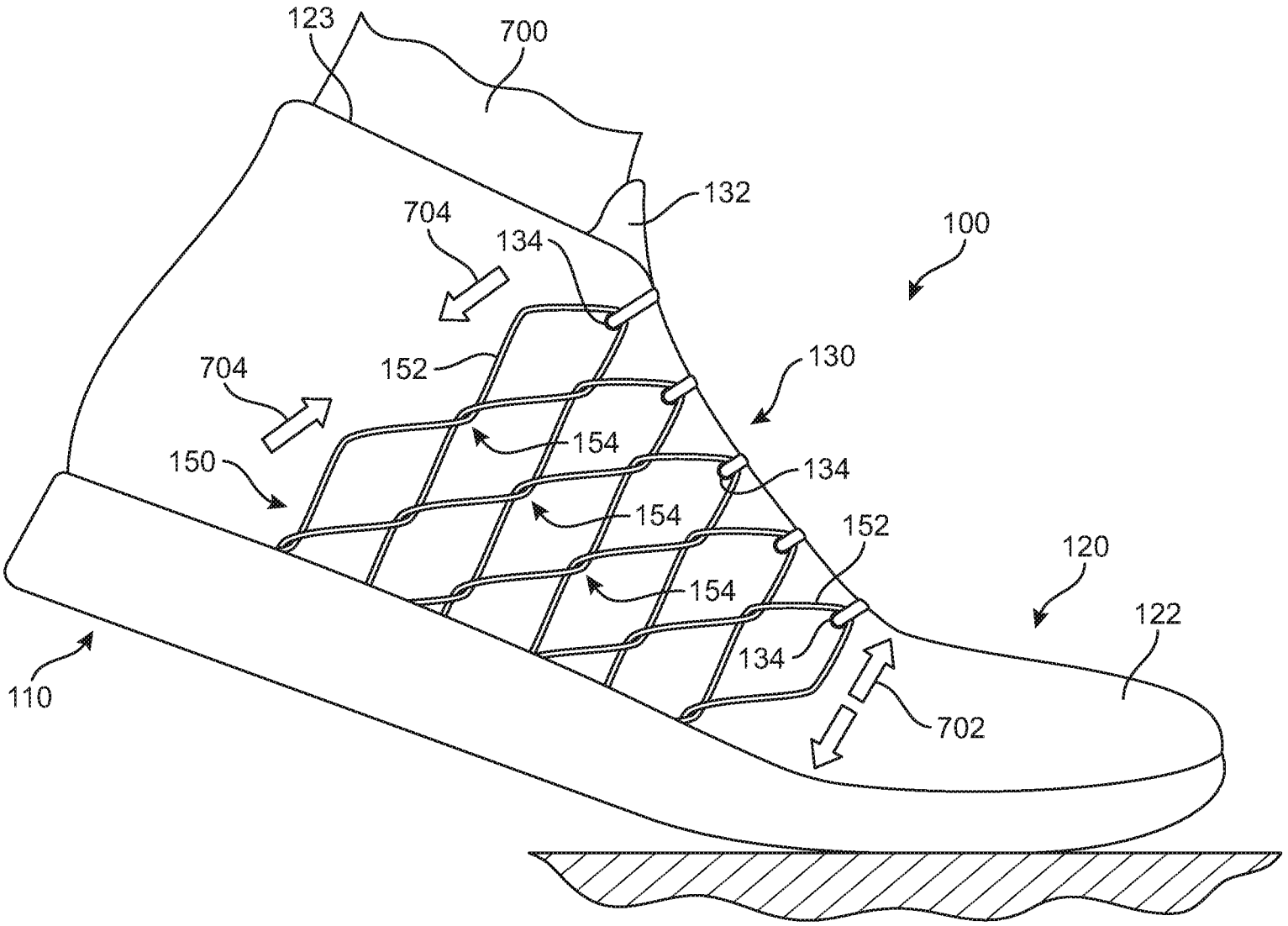
FIG. 7 is a lateral side elevational view of the article of footwear in a flexed configuration.

FIG. 7 illustrates a representation of article of footwear 100 including tensile support structure 150 in a flexed configuration. As described above, tensile support structure 150 can distribute tensile forces across various portions of upper 120. One example of this force distribution is illustrated, where a foot 700 of a wearer is disposed within upper 120, and an input force 702 is generated during an athletic motion, for example, a cutting or pushing motion that flexes foot 700. In this example, input force 702 is located towards the forefoot region of article 100, near the source of the athletic motion. The chain-linked arrangement of strands 152 distributes input force 702 through tensile support structure 150 and causes a reaction force 704 to be exerted on another portion of article 100. As shown in FIG. 7, reaction force 704 is exerted on the opposite end of tensile support structure 150, located near the heel region of article 100 and rearwardly of the location of input force 702.

In an exemplary embodiment, reaction force 704 may be directed in an opposite direction as input force 702. For example, when input force 702 is directed in an approximately outward direction along a vertical axis of article 100 between lacing region 130 and sole structure 110, reaction force 704 can be directed in an approximately inward direction along the vertical axis. With this configuration, an athletic motion located near the forefoot region of article 100 can pull upper 120 tighter to foot 700 near the heel region of article 100 by distribution of the tensile forces through the chain-linked configuration of tensile support structure 150.

Additionally, in some cases, the distribution of tensile forces through tensile support structure 150 can also cause plurality of strands 152 to move closer to exterior surface 21 of upper 120 and/or press base layer 122 of upper 120 inward towards foot 700. With this distribution of tensile force through the chain-linked arrangement of plurality of strands 152, tensile support structure 150 can assist with conforming upper 120 to foot 700 of a wearer. The distribution of forces through tensile support structure 150 can also assist with eliminating or reducing "hot spots" on upper 120 where concentrated forces may be felt by foot 700 of a wearer. By providing an interconnected or intertwined chain-link arrangement of strands 152, tensile support structure 150 distributes these forces over a greater area of foot 700 of the wearer.

The distribution of tensile forces through the chain-linked plurality of strands 152 forming tensile support structure 150 may be described in further detail with reference to FIGS. 8 through 10.

Figure 8:
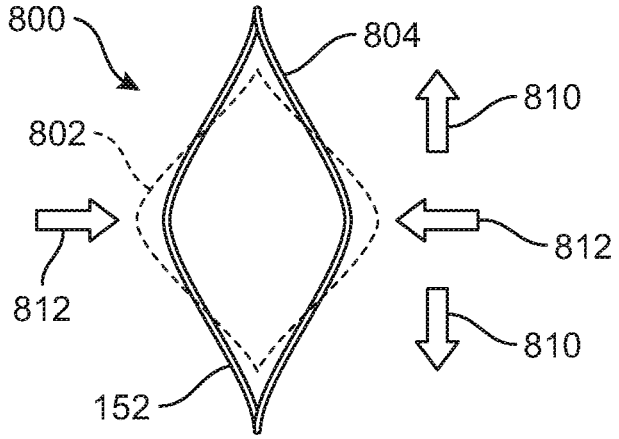
FIG. 8 is a schematic view of an exemplary embodiment of one portion of the tensile support structure in a flexed configuration.

FIG. 8 illustrates the distribution of tensile forces through a single diamond-shaped portion 800 formed by plurality of strands 152 of tensile support structure 150. In this embodiment, diamond-shaped portion 800 can be in an unflexed or relaxed configuration 802 (shown in outline). Upon the application of tensile forces, for example, an input force 810 directed in an approximately outward direction along a vertical axis of diamond-shaped portion 800, diamond-shaped portion 800 can be in a flexed configuration 804. As shown in FIG. 8, the change in the shape of diamond-shaped portion 800 from unflexed configuration 802 to flexed configuration 804 causes a narrowing of diamond-shaped portion 800, such that it becomes longer along the vertical axis and shorter across the middle. The corresponding narrowing of diamond-shaped portion 800 in flexed configuration 804 generates a reaction force 812 that pulls opposite sides of diamond-shaped portion 800 inward.

Figure 9:
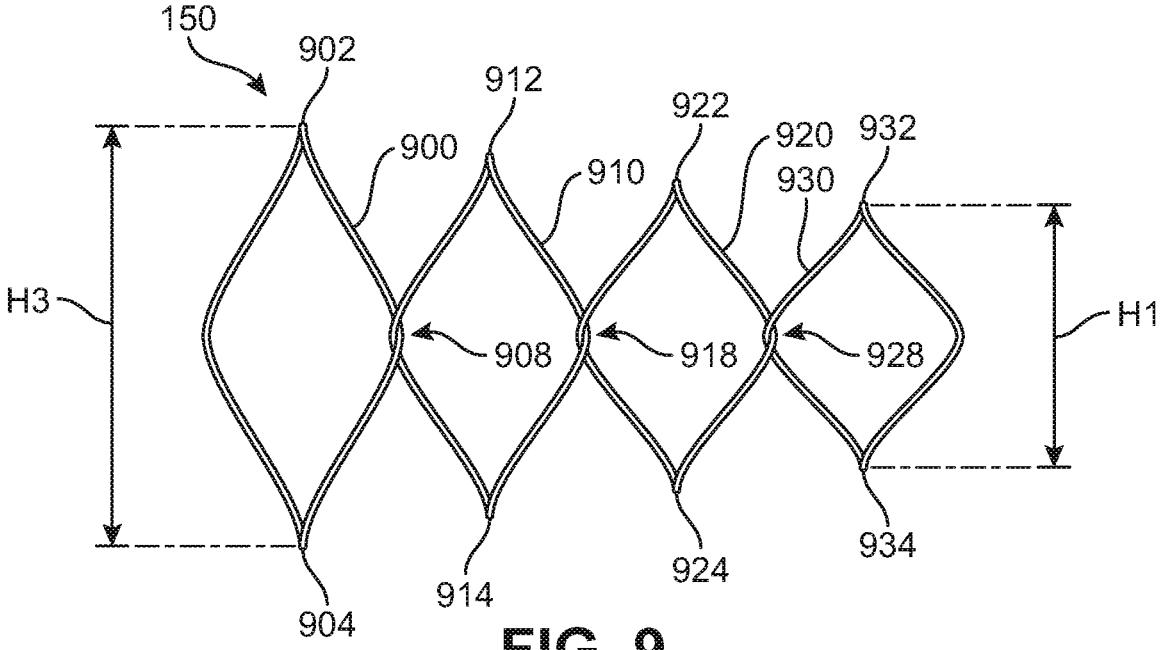
FIG. 9 is a schematic view of an exemplary embodiment of a portion of the tensile support structure.

FIG. 9 illustrates one row of a chain-linked arrangement of plurality of strands 152 forming tensile support structure 150. In this embodiment, four diamond-shaped portions similar to diamond-shaped portion 800 are joined together at intertwined links. In particular, a first diamond-shaped portion 900 and a second diamond-shaped portion 910 are joined at a first link 908, second diamond-shaped portion 910 and a third diamond-shaped portion 920 are joined at second link 918, and third diamond-shaped portion 920 and a fourth diamond-shaped portion 930 are joined at a third link 928.

In an exemplary embodiment, the row of chain-linked plurality of strands 152 forming tensile support structure 150 shown in FIG. 9 can be one of lateral side 16 or medial side 18 of upper 120, with first diamond-shaped portion 900 being located near the heel region of article 100 and fourth diamond-shaped portion 930 being located near the forefoot region of article 100.

As with diamond-shaped portion 800 above, the row of chain-linked plurality of strands 152 forming tensile support structure 150 shown in FIG. 9 may be in an initially unflexed or relaxed configuration. In this unflexed configuration, each of the diamond-shaped portions has a shape extending between a top end and a bottom end. For example, first diamond-shaped portion 900 extends between a first top end 902 and a first bottom end 904, second diamond-shaped portion 910 extends between a second top end 912 and a second bottom end 914, third diamond-shaped portion 920 extends between a third top end 922 and a third bottom end 924, and fourth diamond-shaped portion 930 extends between a fourth top end 932 and a fourth bottom end 934.

In this unflexed configuration, fourth diamond-shaped portion 930 may have a distance between fourth top end 932 and fourth bottom end 934 that is equal to a first height H1. Similarly, in the unflexed configuration, first diamond-shaped portion 900 may have a distance between first top end 902 and first bottom end 904 that is equal to a third height H3. In this embodiment, first height H1 is smaller than third height H3. Next, as will be illustrated in reference to FIG. 10 below, a tensile force can be applied to a portion of the row of chain-linked plurality of strands 152 forming tensile support structure 150 to move the strands to a flexed configuration.

Figure 10:
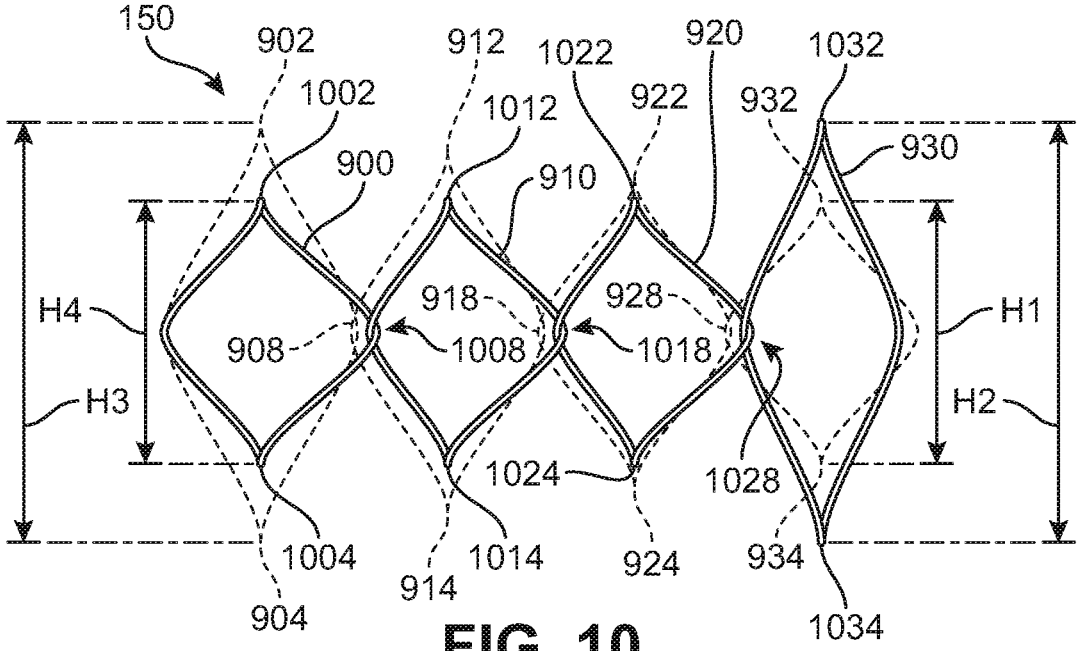
FIG. 10 is a schematic view of an exemplary embodiment of a portion of the tensile support structure in a flexed configuration.

FIG. 10 illustrates a schematic view of the distribution of tensile forces through the chain-linked arrangement of tensile support structure 150 that causes an input force at one portion to generate a complementary reaction force at another portion. As shown in FIG. 10, fourth diamond-shaped portion 930 is in a flexed configuration due to an input force directed in an approximately outward direction along a vertical axis that causes a narrowing of fourth diamond-shaped portion 930 in a similar manner as described above with reference to FIG. 8.

In this flexed configuration, fourth diamond-shaped portion 930 has a distance between flexed fourth top end 1032 and flexed fourth bottom end 1034 that is equal to a second height H2. Second height H2 is greater than first height H1 of fourth diamond-shaped portion 930 in the unflexed configuration (shown in outline). In changing shape from the unflexed configuration to the flexed configuration, fourth diamond-shaped portion 930 becomes narrower across the middle as the distance between flexed fourth top end 1032 and flexed fourth bottom end 1034 increases. This narrowing exerts a force to each of the additional chain-linked portions of tensile support structure 150.

In particular, as shown in FIG. 10, the input force on fourth diamond-shaped portion 930 displaces each of first link 908, second link 918, and third link 928 to move to a flexed first link 1008, a flexed second link 1018, and a flexed third link 1028 in the flexed configuration of FIG. 10. Each of flexed first link 1008, flexed second link 1018, and flexed third link 1028 are located closer to fourth diamond-shaped portion 930 than first link 908, second link 918, and third link 928 in the unflexed configuration.

This displacement of the intertwined links distributes the input force from fourth diamond-shaped portion 930 through tensile support structure 150. In an exemplary embodiment, the distribution of tensile forces generates a corresponding reaction force at first diamond-shaped portion 900. As shown in FIG. 10, the distribution of tensile force pulls first link 908 in a direction towards fourth diamond-shaped portion 930 and causes first top end 902 and first bottom end 904 to move closer together such that a distance between a flexed first top end 1002 and a flexed first bottom end 1004 is equal to a fourth height H4. Fourth height H4 is smaller than third height H3 of first diamond-shaped portion 900 in the unflexed configuration (shown in outline). With this configuration, the reaction force at first diamond-shaped portion 900 is directed inward in an approximately opposite direction as input force applied to fourth diamond-shaped portion 930.

Other portions of tensile support structure 150 undergo a similar change when transitioning from the unflexed configuration to the flexed configuration. For example, second diamond-shaped portion 910 moves between second top end 912 and second bottom end 914 to a flexed second top end 1012 and a flexed second bottom end 1014 when tensile forces are distributed through flexed first link 1008 and flexed second link 1018. In addition, third diamond-shaped portion 920 moves from third top end 922 and third bottom end 924 to a flexed third top end 1022 and a flexed third bottom end 1024 when tensile forces are distributed through flexed second link 1018 and flexed third link 1028.

Thus, in some embodiments, as described herein and shown in the figures, the tensile support structure is disposed proximate to the exterior surface of the base layer, the tensile support structure comprises a plurality of strands that are interlinked to distribute tensile forces across the base layer. The plurality of strands comprise a first strand and a second strand that each extends along a medial or lateral side of the upper from the sole structure to a lace region of the upper. Each of the first and second strands comprises an ascending portion and a descending portion, and the respective ascending portion and descending portion of the first strand are self-linked at a single location between the sole structure and the lace region, and the respective ascending portion and descending portion of the second strand are self-linked at another single location between the sole structure and the lace region. The first and second strands are adjacent-linked to each other at an area that is spaced apart from the single locations where the respective first and second strands are self-linked, the ascending portion extends from a lower region of the upper to the lace region, the descending portion extends from the lacing region to the lower region of the upper, and the respective strand extends around a respective one of the lace-receiving openings. The first and second strands define one or more diamond-shape portions between the areas where the strands are adjacent-linked and self-linked.

In embodiments where tensile support structure 150 is disposed on medial side 18 and/or lateral side 16, this corresponding reaction force transmitted through tensile support structure 150 can cause an input force located near the forefoot region to be distributed through tensile support structure 150 to generate a reaction force at another portion located near the heel region of the article of footwear.

Additionally, the distribution of tensile forces through tensile support structure 150 as described with reference to FIG. 10 can also generate a longitudinal conformance that pulls plurality of strands 152 to move closer to exterior surface 21 of upper 120 and/or press base layer 122 of upper 120 inward towards the foot of the wearer. That is, the pull exerted on each of the intertwined links of tensile support structure 150 is directed in a longitudinal direction between the heel region and the forefoot region of article 100. As shown in FIG. 10, when tensile forces pull on each of flexed first link 1008, flexed second link 1018, and flexed third link 1028, tensile support structure 150 can move closer towards exterior surface 21 of upper 120. With this distribution of tensile force through the chain-linked arrangement of plurality of strands 152, tensile support structure 150 can assist with conforming upper 120 to the foot of a wearer.

The previous embodiments have been described with reference to article 100 including upper 120 formed by base layer 122. In other embodiments, an article of footwear including a tensile support structure may have different types or arrangements of uppers. For example, alternate embodiments of articles of footwear with tensile support structures according to the principles disclosed herein can include uppers as shown in FIGS. 11-13 and FIGS. 14-16, described in more detail below.

In some embodiments, an upper for an article of footwear may include multiple layers. Accordingly, an alternate embodiment of article of footwear 1100 including a multiple layer upper 1120 is described in FIGS. 11-13.

Figure 11:
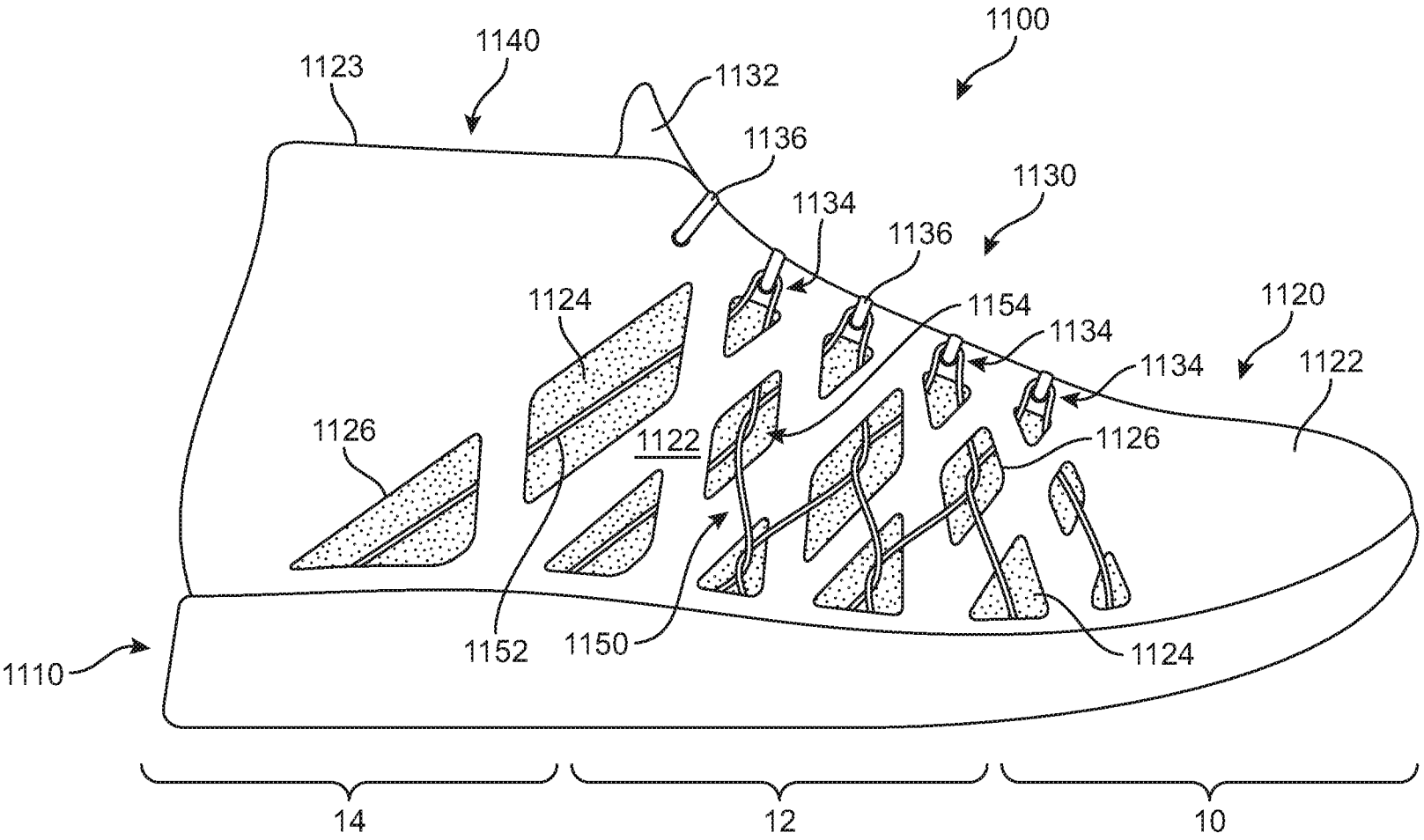
FIG. 11 is a lateral side view of an alternate embodiment of an article of footwear including a tensile support structure.
Figure 13:
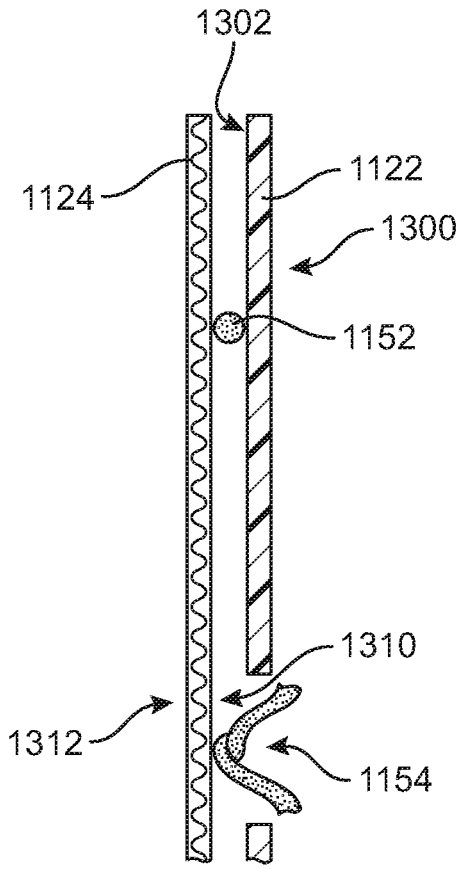
FIG. 13 is a cross-sectional view of the portion of the lateral side of the alternate embodiment of the article of footwear taken along line 13-13 in FIG. 12.

Referring now to FIG. 11, article 1100 includes upper 1120 and sole structure 1110. Sole structure 1110 is secured to upper 1120 and extends between the foot and the ground when article 1100 is worn. In this embodiment, upper 1120 includes multiple layers, including a cover layer 1122 and a base layer 1124. Cover layer 1122 and base layer 1124 are generally co-extensive and have surfaces that are disposed adjacent to one another over the extent of upper 1120. For example, as shown in FIG. 13, an outside surface 1300 of cover layer 1122 can form a majority of an exterior of upper 1120 and an inside surface 1302 of cover layer 1122 is disposed adjacent to and facing towards an exterior surface 1310 of base layer 1124. An interior surface 1312 of base layer 1124 is disposed opposite exterior surface 1310 and faces towards the interior void of upper 1120. In some cases, interior surface 1312 can form a majority of an interior of upper 1120.

Article 1100 also includes a tensile support structure 1150 that is disposed over upper 1120. Tensile support structure 1150 is formed by a plurality of strands 1152 that are connected in a chain-linked arrangement at a plurality of intertwined links 1154. In this embodiment, tensile support structure 1150, plurality of strands 1152, and plurality of intertwined links 1154 may be substantially similar to tensile support structure 150, plurality of strands 152, and plurality of intertwined links 154 described above with reference to the exemplary embodiment of article 100.

Additionally, article 1100 can include other similar components as article 100, described above. For example, article 1100 includes a collar 1123 that forms a throat opening 1140 proving access to the interior void of upper 1120. Each of collar 1123 and throat opening 1140 can be substantially similar to collar 123 and throat opening 140, described above. Upper 1120 of article 1100 also can include a lacing region 1130 extends forward from collar 1123 and throat opening 1140 in a substantially similar manner as lacing region 130, described above. Lacing region 1130 can also include a tongue 1132 and lace 1136, substantially similar to tongue 132 and lace 136. Lace 1136 can extend through a plurality of lace-receiving elements that are configured as a plurality of lace apertures 1134. Lace apertures 1134 can be substantially similar to lace apertures 134, including any optional configurations described above.

In the present embodiment, tensile support structure 1150 can be arranged so as to have portions that extend over and/or between different layers forming upper 1120 of article 1100. That is, because upper 1120 includes multiple layers, including base layer 1124 and cover layer 1122, tensile support structure 1150 can be disposed over upper 1120 in a different manner than with article 100. In an exemplary embodiment, tensile support structure 1150 can have portions that are (a) disposed between exterior surface 1310 of base layer 1124 and inside surface 1302 of cover layer 1122 and (b) disposed over outside surface 1300 of cover layer 1122.

In other embodiments, tensile support structure 1150 can have other arrangements, for example, with tensile support structure 1150 being disposed almost entirely between exterior surface 1310 of base layer 1124 and inside surface 1302 of cover layer 1122, or with tensile support structure 1150 being disposed almost entirely over outside surface 1300 of cover layer 1122.

Figure 12:
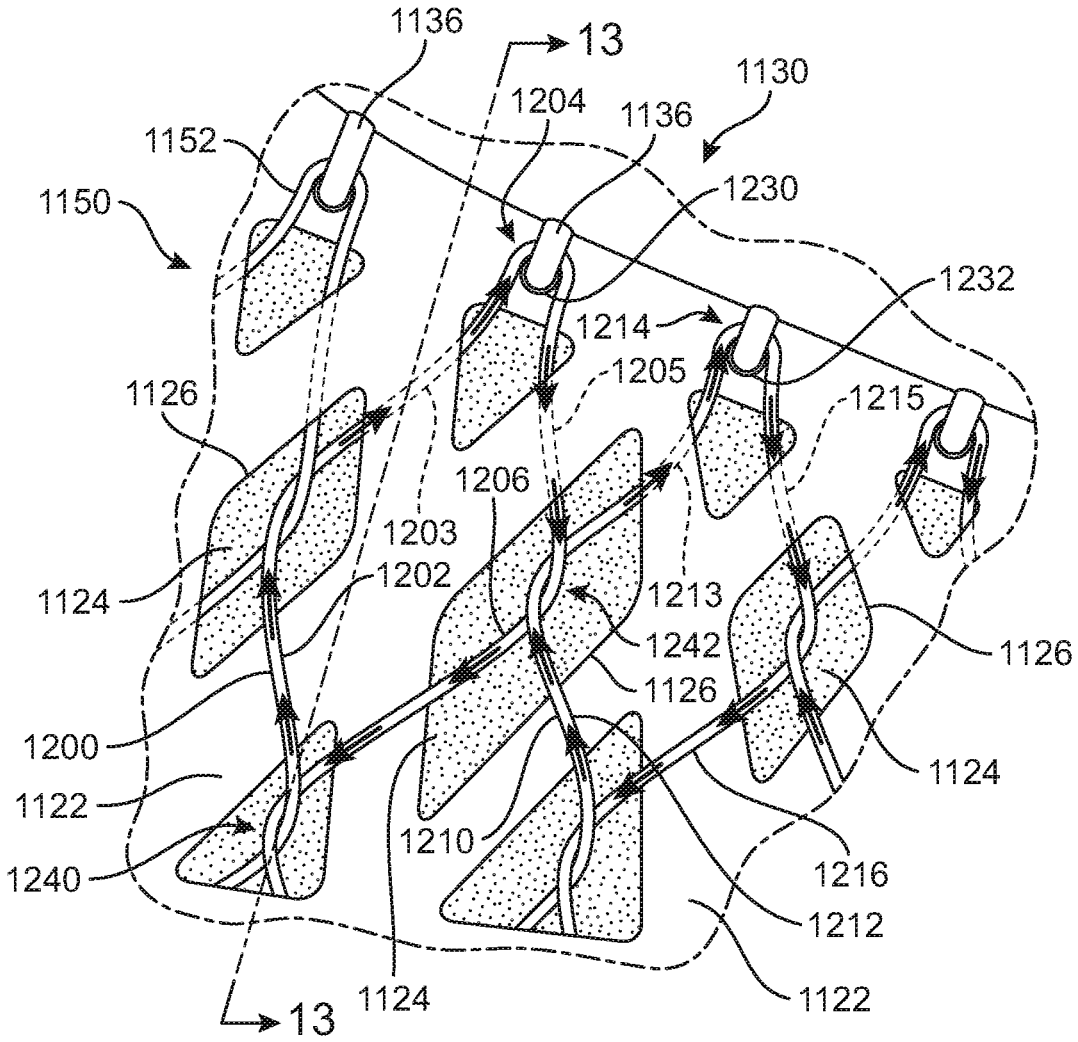
FIG. 12 is an enlarged view of a portion of the lateral side of the alternate embodiment of an article of footwear.

As shown in FIGS. 11 and 12, cover layer 1122 of upper 1120 includes a plurality of openings 1126 that expose base layer 1120. Plurality of openings 1126 also provide access for portions of plurality of strands 1152 of tensile support structure 1150 extend out from beneath cover layer 1122 to extend over outside surface 1300 of cover layer 1122 and/or to extend under cover layer 1122 to be located between exterior surface 1310 of base layer 1124 and inside surface of cover layer 1122. That is, plurality of openings 1126 allow plurality of strands 1152 of tensile support structure 1150 to be alternately located between cover layer 1122 and base layer 1124 and over cover layer 1122 so as to be exposed to the exterior of the upper. With this arrangement, tensile support structure 1150 may interact with and distribute forces to portions of upper 1120 of article 1100.

Referring now to FIG. 12, an enlarged view of a portion of tensile support structure 1150 is shown relative to cover layer 1122 and base layer 1124 of upper 1120. As noted above, tensile support structure 1150 is formed by one or more strands or strand sections of plurality of strands 1152 that are connected at adjacent portions to form intertwined links 1154. For example, in this embodiment, plurality of strands includes a first strand 1200 and a second strand 1210. First strand 1200 is located adjacent to second strand 1210.

In this embodiment, each of first strand 1200 and second strand 1210 include portions extending between lacing region 1130 and the lower region of upper 1120 near sole structure 1110. Together the portions of each strand form a loop near lacing region 1130 that extends over lace apertures 1134 for receiving lace 1136. For description purposes, the portions may be described as ascending portions and descending portions, as described with reference to FIG. 6 above. In addition, in this alternate embodiment of article 1100, portions of each strand may also be (a) covered, i.e., located between base layer 1124 and cover layer 1122 or (b) exposed, i.e., disposed over cover layer 1122.

For example, first strand 1200 includes a first exposed ascending portion 1202 that extends upwards from the lower region near sole structure 1110 in a direction towards lacing region 1130. First exposed ascending portion 1202 extends over cover layer 1122. At one of the plurality of openings 1126 in cover layer 1122, first strand 1200 extends beneath cover layer 1112 and a first covered ascending portion 1203 is located between base layer 1124 and cover layer 1122. Next, at lacing region 1130, first strand 1200 forms a first loop 1204 that extends around first lace aperture 1230 and a first covered descending portion 1205 of first strand 1200 extends back down from lacing region 1130 through another one of plurality of openings 1126 so as to again extend beneath cover layer 1122 and over base layer 1124. First strand 1200 continues in a direction towards the lower region of upper 1120 near sole structure 1110 and extends out of another one of plurality of openings 1126 so that a first exposed descending portion 1206 again extends over cover layer 1122 on the exterior of upper 1120.

In a similar manner, second strand 1210 includes a second exposed ascending portion 1212 that extends upwards from the lower region near sole structure 1110 in a direction towards lacing region 1130. Second exposed ascending portion 1212 extends over cover layer 1122, and at one of the plurality of openings 1126 in cover layer 1122, second strand 1210 extends beneath cover layer 1112 so that a second covered ascending portion 1213 is located between base layer 1124 and cover layer 1122. Next, at lacing region 1130, second strand 1210 forms a second loop 1214 that extends around second lace aperture 1232 and a second covered descending portion 1215 of second strand 1210 extends back down from lacing region 1130 through another one of plurality of openings 1126 so as to again extend beneath cover layer 1122 and over base layer 1124. Second strand 1210 continues in a direction towards the lower region of upper 1120 near sole structure 1110 and extends out of another one of plurality of openings 1126 so that a second exposed descending portion 1216 again extends over cover layer 1122 on the exterior of upper 1120.

Plurality of intertwined links 1154 between adjacent portions of strands 1152 can be arranged as described above in reference to FIG. 6, including self-linked and adjacent-linked types of intertwined links. As shown in FIG. 12, a first link 1240 connects first exposed ascending portion 1202 and first exposed descending portion 1206 of first strand 1200. First link 1240 may be described as being self-linked because it connects adjacent ascending and descending portions of the same strand, for example, first strand 1200. In comparison, a second link 1242 connects first exposed descending portion 1206 of first strand 1200 and second exposed ascending portion 1212 of second strand 1210. Second link 1242, therefore, may be described as being adjacent-linked because it connects adjacent ascending and descending portions of different strands, for example, first strand 1200 and second strand 1210. The remaining links of plurality of links 1154 have a substantially similar configuration.

In this embodiment, each opening of plurality of openings 1126 corresponds with a location of one of plurality of intertwined links 1154. With this configuration, the distribution of tensile forces through tensile support structure 1150 that occurs by pulling intertwined links in a manner as described in FIGS. 8 through 10 above may be accommodated by openings 1126. Additionally, by alternately extending portions of plurality of strands 1152 over and under cover layer 1122, cover layer 1122 of upper 1120 may be at least partially connected to and interact with tensile support structure 1150 in the area between lacing region 1130 and the lower region where upper 1120 connects to sole structure 1110. With this arrangement, tensile support structure 1150 may provide additional conformance of upper 1120 to a foot of a wearer.

In some embodiments, an upper for an article of footwear may incorporate a knitted component that includes a tensile support structure. Accordingly, another alternate embodiment of article of footwear 1400 including an upper 1420 incorporating a knitted component 1422 and tensile support structure 1450 is described in FIGS. 14-16. Article 1400 includes tensile support structure 1450 that is connected to and/or formed of unitary knit construction with knitted component 1422 that is incorporated into upper 1420. Tensile support structure 1450 is formed by a plurality of strands 1452 that are connected in a chain-linked arrangement at a plurality of intertwined links 1454. In this embodiment, tensile support structure 1450, plurality of strands 1452, and plurality of intertwined links 1454 may be substantially similar to tensile support structures 150 and/or 1150, plurality of strands 152 and/or 1152, and plurality of intertwined links 154 and/or 1154 described above with reference to the embodiments of article 100 and article 1100.

Figure 14:
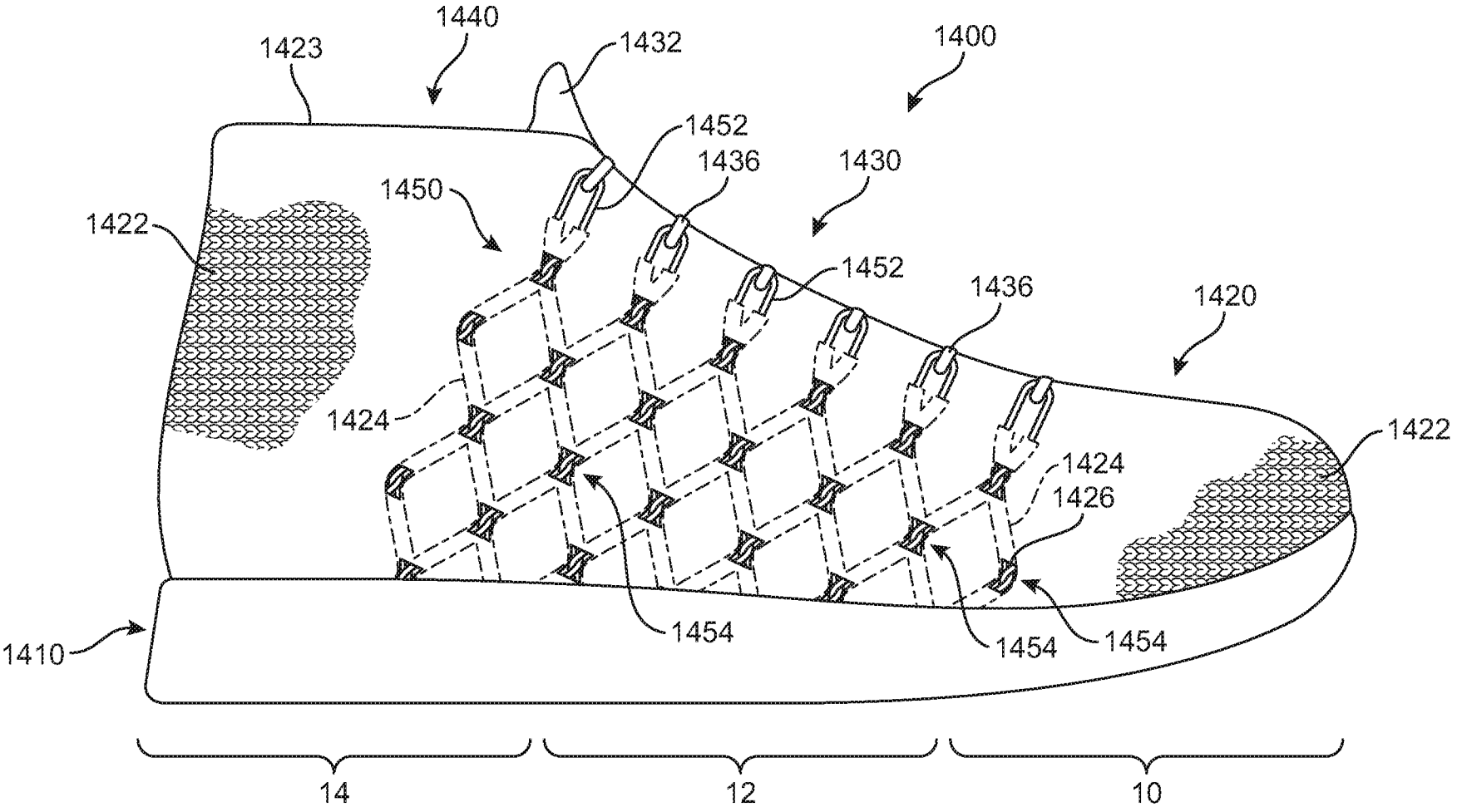
FIG. 14 is a is a lateral side view of an alternate embodiment of an article of footwear incorporating a knitted component including a tensile support structure.

Referring now to FIG. 14, article 1400 includes upper 1420 and sole structure 1410. Sole structure 1410 is secured to upper 1420 and extends between the foot and the ground when article 1400 is worn. In this embodiment, upper 1420 includes knitted component 1422. Knitted component 1422 can be formed by a knitting process, such as a weft-knitting process, including flat-knitting or circular-knitting processes, to interloop yarns that form knitted component 1422. In this embodiment, a plurality of strands 1452 of tensile support structure 1450 extends through a plurality of knit tubes 1424 formed in knitted component 1422 of upper 1420. Plurality of strands may be knit into knitted component forming upper using methods for inlaying tensile elements or strands described in any one or more of commonly-owned U.S. Pat. No. 8,490,299 to Dua et al., U.S. Pat. No. 8,839,532 to Huffa et al., and U.S. Pat. No. 9,060,570 to Huffa, the disclosures of which are hereby incorporated by reference in their entirety.

Figure 15:
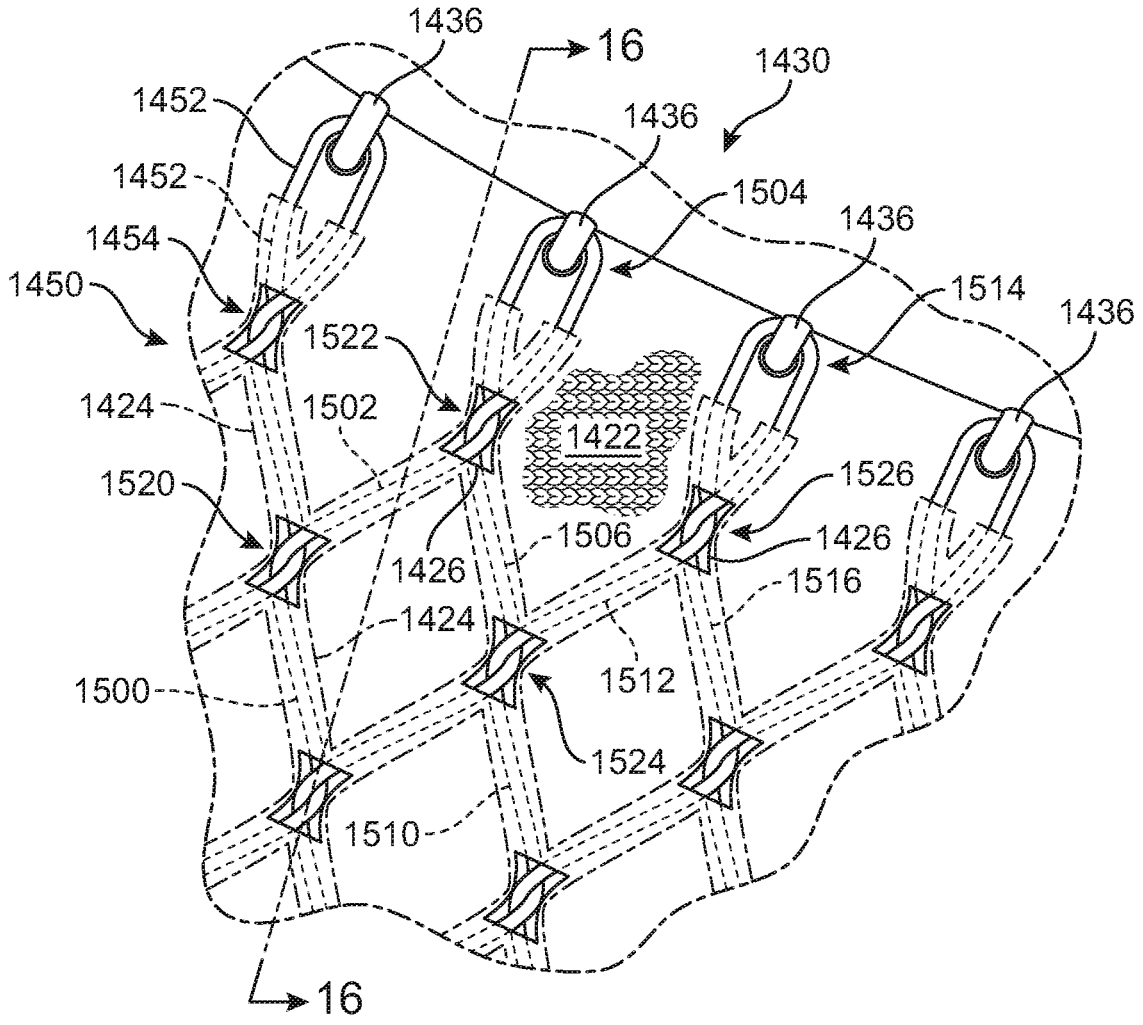
FIG. 15 is an enlarged view of a portion of the lateral side of the alternate embodiment of an article of footwear incorporating a knitted component.
Figure 16:
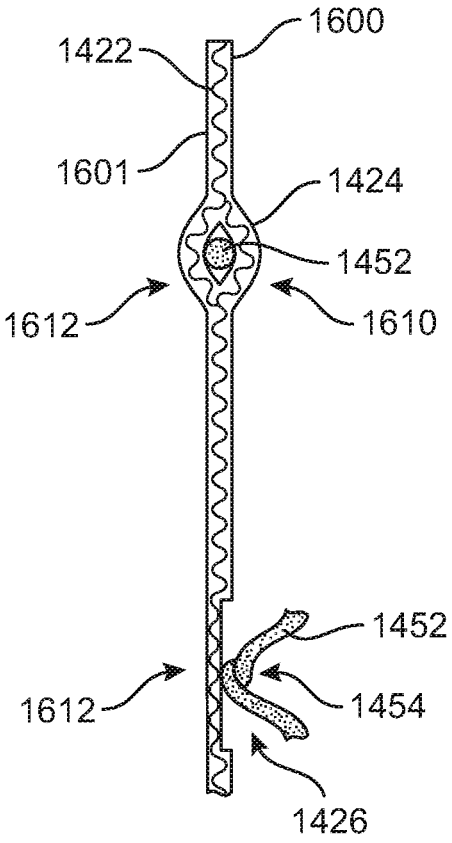
FIG. 16 is a cross-sectional view of the portion of the lateral side of the alternate embodiment of the article of footwear incorporating a knitted component taken along line 16-16 in FIG. 15.

Referring to FIGS. 14 and 15, for example, knitted component 1422 includes various knit tubes 1424 in which portions of strands 1452 are located. Knit tubes 1424 are generally hollow structures formed by two overlapping and at least partially coextensive knit layers, including a first knit layer 1610 and a second knit layer 1612, as depicted in FIG. 16. Although the sides or edges of one knit layer of the knitted material forming knit tubes 1424 may be secured to the other knit layer, a central area is generally unsecured such that another element (e.g., strands 1452) may be located between the two knit layers and pass through knit tubes 1424. In this embodiment, plurality of knit tubes 1424 cover portions of strands 1452, while another portion of strands 1452 is exposed on the exterior of upper 1420 through openings 1426. The exposed portion of strands 1452 corresponds to location of plurality of intertwined links 1454 connecting adjacent portions of strands 1452.

Additionally, article 1400 can include other similar components as article 100 and/or article 1100, described above. For example, article 1400 includes a collar 1423 that forms a throat opening 1440 proving access to the interior void of upper 1420. Each of collar 1423 and throat opening 1440 can be substantially similar to collar 123 and/or 1123 and throat opening 140 and/or 1140, described above. Upper 1420 of article 1400 also can include a lacing region 1430 extends forward from collar 1423 and throat opening 1440 in a substantially similar manner as lacing region 130 and/or 1130, described above. Lacing region 1430 can also include a tongue 1432 and lace 1436, substantially similar to tongue 132 and/or 1132 and lace 136 and/or 1136. Lace 1436 can extend through a plurality of lace-receiving elements that are configured as a plurality of lace apertures 1434. Lace apertures 1434 can be substantially similar to lace apertures 134 and/or 1134, including any optional configurations described above.

In the present embodiment, tensile support structure 1450 can be arranged so as to have portions of plurality of strands 1452 that extend through knit tubes 1424 formed by overlapping knit layers of knitted component 1422 that is incorporated into upper 1420 of article 1400 and portions that are exposed within a plurality of openings from knit tubes 1424. For example, as shown in FIG. 16, an exterior surface 1600 of knitted component 1422 can form a majority of an exterior of upper 1420 and an interior surface 1601 of knitted component 1422 is disposed opposite exterior surface 1600 and faces towards the interior void of upper 1420. In some cases, interior surface 1601 can form a majority of an interior of upper 1420. In an exemplary embodiment, tensile support structure 1450 can have portions of plurality of strands 1452 that are (a) disposed within knit tubes 1424 formed by overlapping first knit layer 1610 and a second knit layer 1612 and (b) exposed from knit tubes 1424 at openings 1426 to the exterior of upper 1420. With this arrangement, portions of tensile support structure 1450 can be connected to and/or formed of unitary knit construction with knitted component 1422 that is incorporated into upper 1420.

Referring now to FIG. 15, an enlarged view of a portion of tensile support structure 1450 is shown relative to knitted component 1422 of upper 1420. As noted above, tensile support structure 1450 is formed by one or more strands or strand sections of plurality of strands 1452 that are connected at adjacent portions to form intertwined links 1454. For example, in this embodiment, plurality of strands includes a first strand 1500 and a second strand 1510. First strand 1500 is located adjacent to second strand 1510.

In this embodiment, each of first strand 1500 and second strand 1510 include two portions extending between lacing region 1430 and the lower region of upper 1420 near sole structure 1410. Together the two portions of each strand form a loop near lacing region 1430 that extends over lace apertures 1434 for receiving lace 1436.

For example, first strand 1500 includes a first ascending portion 1502 that extends upwards from the lower region near sole structure 1410 in a direction towards lacing region 1430. At lacing region 1430, first strand 1500 forms a first loop 1504 that extends around one of the plurality of lace apertures 1434 and a first descending portion 1506 of first strand 1500 extends back down from lacing region 1430 in a direction towards the lower region of upper 1420 near sole structure 1410. In a similar manner, second strand 1510 includes a second ascending portion 1512 that extends upwards towards lacing region 1430 and forms a second loop 1514 around another one of the plurality of lace apertures 1434 before a second descending portion 1516 extends back towards the lower region of upper 1420 near sole structure 1410.

Plurality of intertwined links 1454 between adjacent portions of strands 1452 can be arranged as described above in reference to FIG. 6, including self-linked and adjacent-linked types of intertwined links. As shown in FIG. 15, a first link 1520 connects first ascending portion 1502 of first strand 1500 to an adjacent portion of a different strand. First link 1520 may be described as being adjacent-linked because it connects adjacent ascending and descending portions of different strands. In comparison, a second link 1522 connects first ascending portion 1502 of first strand 1500 to first descending portion 1506 of first strand 1500. Second link 1522 may be described, therefore, as being self-linked because it connects adjacent ascending and descending portions of the same strand, for example, first strand 1500. The remaining links of plurality of links 1454 have a substantially similar configuration, including a third link 1524 and a fourth link 1526.

In this embodiment, each opening of plurality of openings 1426 of knit tubes 1424 corresponds with a location of one of plurality of intertwined links 1454. With this configuration, the distribution of tensile forces through tensile support structure 1450 that occurs by pulling intertwined links in a manner as described in FIGS. 8 through 10 above may be accommodated by openings 1426.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims. Moreover, as used in the claims "any of" when referencing the previous claims is intended to mean: (i) any one claim; or (ii) any combination of two or more claims referenced.

What is claimed is:

1. An article of footwear having an upper and a sole structure secured to the upper, the upper comprising:

a base layer having an interior surface and an opposite exterior surface, the base layer forming at least a portion of the upper of the article of footwear and having a plurality of lace-receiving openings; and a tensile support structure disposed proximate to the exterior surface of the base layer, the tensile support structure comprising a plurality of strands that are interlinked to distribute tensile forces across the base layer, the plurality of strands comprising a first strand and a second strand;

wherein the first strand and second strand each extends along a medial or lateral side of the upper from the sole structure to a lace region of the upper, wherein each of the first and second strands comprises an ascending portion and a descending portion, and the respective ascending portion and descending portion of the first strand are self-linked at a single location between the sole structure and the lace region, and the respective ascending portion and descending portion of the second strand are self-linked at another single location between the sole structure and the lace region, wherein the first and second strands are adjacent-linked to each other at an area that is spaced apart from the single locations where the respective first and second strands are self-linked, wherein the ascending portion extends from a lower region of the upper to the lace region, the descending portion extends from the lacing region to the lower region of the upper, and the respective strand extends around a respective one of the lace-receiving openings, and wherein the first and second strands define one or more diamond-shape portions between the areas where the strands are adjacent-linked and self-linked.

2. The article of footwear according to claim 1, wherein the plurality of strands is secured between the upper and the sole structure at the lower region of the upper.

3. The article of footwear according to claim 1, further comprising a lace that extends through the plurality of lace-receiving openings.

4. The article of footwear according to claim 3, wherein the lace extends through at least a first lace loop formed by the first strand of the plurality of strands and a second lace loop formed by the second strand of the plurality of strands.

5. The article of footwear according to claim 4, wherein the first lace loop is disposed proximate a forefoot region of the article of footwear and the second lace loop is disposed nearer to a heel region of the article of footwear than the first lace loop.

6. The article of footwear according to claim 4, wherein a tensile force applied to the first lace loop of the first strand is transmitted through the tensile support structure to the second strand such that an opposing tensile force is applied at the second lace loop.

7. The article of footwear according to claim 1, further comprising a cover layer disposed over at least a portion of the exterior surface of the base layer, the cover layer forming at least a portion of an exterior of the upper of the article of footwear.

8. The article of footwear according to claim 7, wherein at least a first portion of the plurality of strands are disposed between the exterior surface of the base layer and an inside surface of the cover layer and at least a second portion of the plurality of strands are exposed at the exterior of the upper.

9. The article of footwear according to claim 8, wherein the cover layer further comprises one or more openings that extend through the cover layer; and wherein at least one of the first portion of the plurality of strands and the second portion of the plurality of strands extend through the one or more openings.

10. The article of footwear according to claim 1, wherein the base layer comprises a knitted component.

11. The article of footwear according to claim 1, wherein the first and second strands are adjacent-linked to each other at two different locations.

12. The article of footwear according to claim 1, wherein one or more of the plurality of strands are unsecured to the base layer between the lower region of the upper and the lace region.

* * * * *